US005269694A

United States Patent [19]

Kachlic et al.

[11] Patent Number: 5,269,694

[45] Date of Patent: Dec. 14, 1993

[54] SURFACE MOUNT ELECTRICAL CONNECTOR

[75] Inventors: Jerry D. Kachlic, Milpitas, Calif.; AuYong C. Seong, Singapore, Singapore

[73] Assignee: Molex Incorporated, Lisle, Ill.

[21] Appl. No.: 965,640

[22] Filed: Oct. 23, 1992

[51] Int. Cl.[5] ..... H01R 13/00

[52] U.S. Cl. ..... 439/79; 439/83

[58] Field of Search ..... 439/65, 68–73, 439/76, 78, 79, 83

[56] References Cited

U.S. PATENT DOCUMENTS

| | | | |
|---|---|---|---|
| 2,470,618 | 5/1949 | Holden | 439/65 |
| 3,085,139 | 4/1963 | Wright | 439/83 |
| 3,997,231 | 12/1976 | Sherwood | 439/76 |
| 4,621,880 | 11/1986 | Rush | 339/17 LC |
| 4,645,287 | 2/1987 | Olsson | 339/125 R |
| 4,732,565 | 3/1988 | Ito et al. | 439/79 |
| 4,992,052 | 2/1991 | Verhoeven | 439/62 |
| 5,096,428 | 3/1992 | Lwee et al. | 439/79 |

OTHER PUBLICATIONS

JST Brochure, Author Unknown, Title: HD Connector, Page Unknown.

*Primary Examiner*—Joseph H. McGlynn

*Attorney, Agent, or Firm*—A. A. Tirva; Charles S. Cohen

[57] ABSTRACT

An electrical connector is provided for surface mounting on a printed circuit board. The connector includes an elongated dielectric housing, and mounting clips are provided for mounting the housing on one side of the circuit board at an edge thereof. A plurality of terminals are mounted in the housing, each terminal including a contact pin at one end and a surface mount tail at an opposite end. The contact pins of the terminals are oriented generally parallel to the circuit board and arranged in two rows longitudinally of the housing. The surface mount tails of the terminals are arranged in a common plane for surface engagement with appropriate circuit traces on the one side of the circuit board. The terminals are of identical constructions, with the terminals in one row thereof being oriented 180° relative to the terminals in the other row thereof. Each locking clip includes retention tabs for retaining the locking clips on the housing. The locking clips also include locking legs, independent of the retention tabs, extending into openings in the circuit board for locking the connector against the circuit board.

3 Claims, 3 Drawing Sheets

SURFACE MOUNT ELECTRICAL CONNECTOR

FIELD OF THE INVENTION

This invention generally relates to the art of electrical connectors and, particularly, to a connector or header for surface mounting on a printed circuit board.

BACKGROUND OF THE INVENTION

Printed circuit board electrical connectors have been known for many years wherein the connectors have terminals with solder tails extending therefrom for insertion into holes in a printed circuit board. Miniaturization of such connectors has led to the development of "surface mount" connectors which have terminals with solder tails configured for positioning against and connection to circuit traces or pads on a surface of the board. A wide variety of surface mount connectors have been developed, including terminal pin headers which mount a plurality of terminals with contact pins projecting therefrom for mating with socket-type terminals of a complementary mating connector.

One type of surface mount connector or header is mounted at an edge of a printed circuit board, sometimes in a cut-out notch in the edge, with contact pins of the connector terminals projecting generally parallel to the circuit board away from the edge of the board for interconnection with a complementary connector. Solder tails of the terminals project in an oppsoite direction relative to the pins for interconnection with circuit traces on one side of the board. The contact pins project from the connector in two spaced apart horizontal rows parallel to the board and with the solder tails of all of the terminals being in a single horizontal plane for connection to the planar array of circuit traces on the one side of the board. Such rows of pins are configured so that one pin from each row is vertically aligned with a pin from the other row along a plane perpendicular to the board and the tails of the terminals with vertically aligned pins are adjacent each other.

One of the problems with surface mount edge connectors or headers as described above, is that two different configurations of terminals have been utilized with one configuration for the top row of pins and the second configuration for the bottom row of pins. That is, when the terminals are utilized in pairs, the contact pins will be arranged in two rows, such as a "top" row and "bottom" row, with the contact pins in each pair being in vertical alignment, i.e. in planes generally perpendicular to the printed circuit board. Of course, the solder tails of the terminals must be arranged in a single or coplanar row for automated interconnection to circuit traces or pads on one side of the circuit board.

Surface mount edge connectors or headers of the character described above are most often intended to be relatively inexpensive electrical components. When differently configured terminals are employed, additional tooling and inventory is required, which increases the cost of the connectors. It would be desirable to provide a surface mount electrical connector wherein all of the terminals are of an identical configuration, notwithstanding the fact that the contact pins of the terminals may be disposed in multiple rows while the solder tails of the terminals are disposed in a single or coplanar row. This invention is directed to satisfying that need and solving the problems identified above and, in turn, reducing the tooling costs of the connector terminals, as well as reducing the inventory of terminals required for such connectors.

In addition, such connectors utilize a boardlock having resilient legs for retaining the connector to the board prior to soldering. Many such boardlocks utilize a separate component, often made of metal, for such purpose. As a result, such separate boardlocks must be securely fastened to the connector. One of the problems with some separate boarlocks is that they are retained to the connector by a portion of the resilient legs. Thus, when the legs flex, the boardlock has a tendency to pull away from the connector housing.

SUMMARY OF THE INVENTION

An object, therefore, of the invention is to provide a new and improved electrical connector or pin header for surface mounting on a printed circuit board, such as at an edge of the board.

Generally, the connector includes an elongated dielectric housing, along with means for mounting the housing to one side of the circuit board at an edge thereof. A plurality of terminals are mounted in the housing, with each terminal having a contact pin at one end and a surface mount tail at an opposite end. The contact pins of the terminals are oriented generally parallel to the circuit board and arranged in two rows longitudinally of the housing. The surface mount tails of the terminals are arranged in a common plane for surface engagement with appropriate circuit traces on the one side of the circuit board.

The invention contemplates that all of the terminals be of identical construction, with the terminals in one row thereof being oriented 180° relative to the terminals in the other row thereof. As disclosed herein, the contact pins are arranged in pairs, with one pin in each pair being disposed in each of the two rows and with the pins in each pair being in a plane generally perpendicular to the circuit board.

Specifically, the contact pins of each terminal defines an axis from which the respective surface mount tail of each terminal is offset. The surface mount tail of each terminal is offset from the axis of the contact pin of the respective terminal in directions both parallel and perpendicular to the circuit board. Preferably, the terminals are stamped and formed components from sheet metal material. Both the contact pins and the surface mount tails of the terminals are generally rectangular in cross-section defining sides thereof generally perpendicular to the circuit board.

The invention also contemplates the provision of a locking clip near each end of the elongated housing. Complementary interengaging retention means are provided between each locking clip and the housing for retaining the clip on the housing. Locking means are provided on each locking clip independent of the retention means and extending through opening means in the printed circuit board for locking against an opposite side of the circuit board. As disclosed herein, the locking means of each locking clip is provided by a pair of legs projecting through the opening means and including hook portions for engaging against the opposite side of the circuit board. The hook portions of the pair of legs are in oppositely facing orientations.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figures 1, 4:
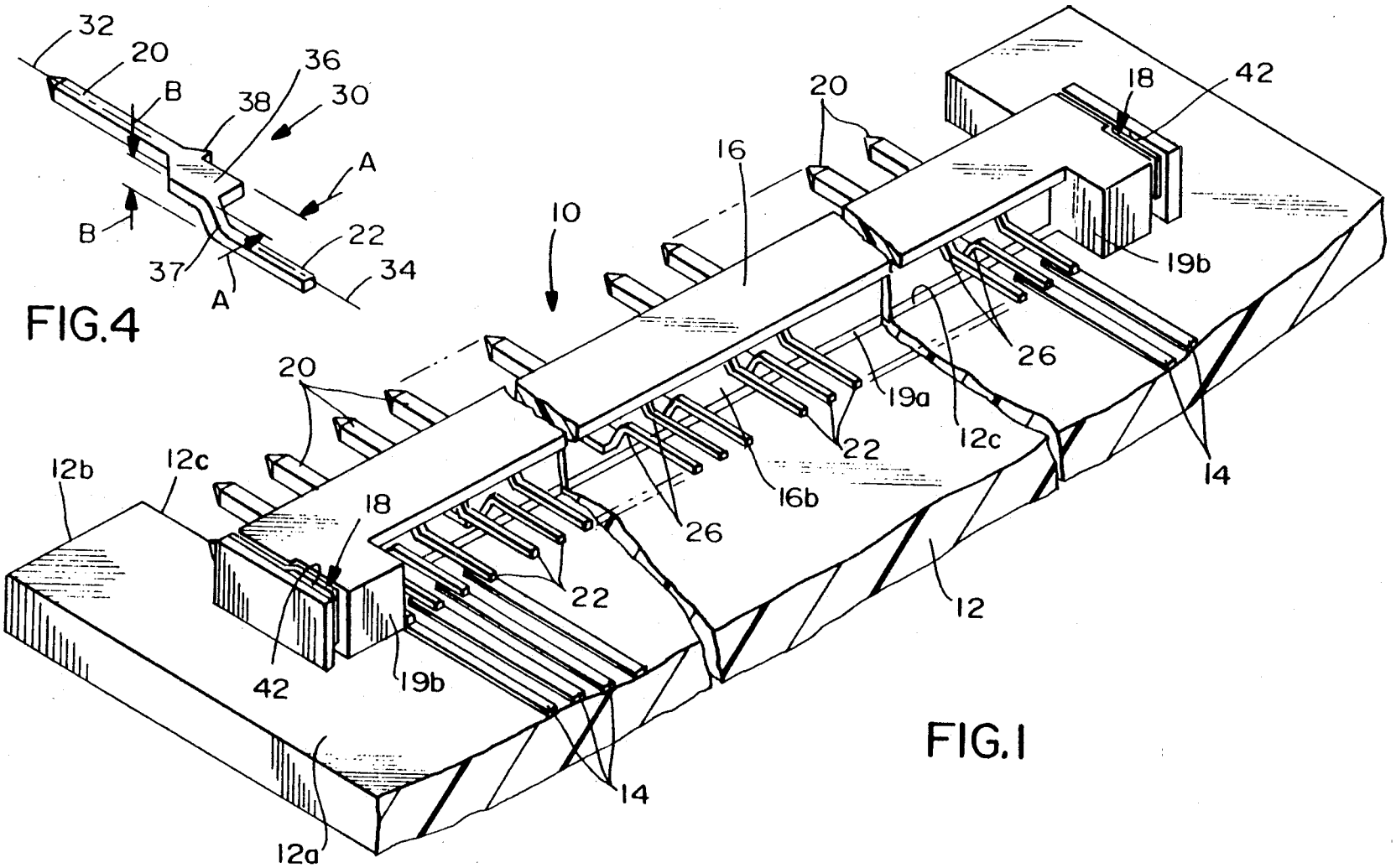
FIG. 1 is a fragmented perspective view of an electrical connector embodying the concepts of the invention and shown surface mounted on a printed circuit board.
FIG. 4 is a perspective view of one of the terminals of the connector.
Figure 2:
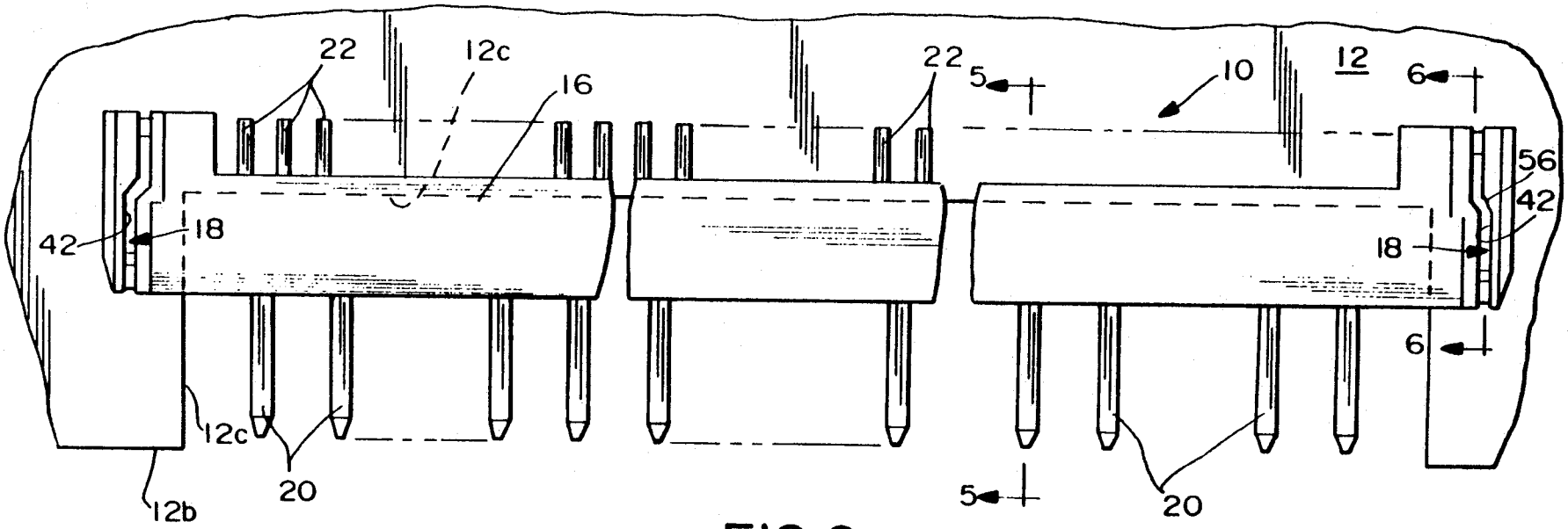
FIG. 2 is a fragmented top plan view of the electrical connector and printed circuit board of FIG. 1.
Figure 3:
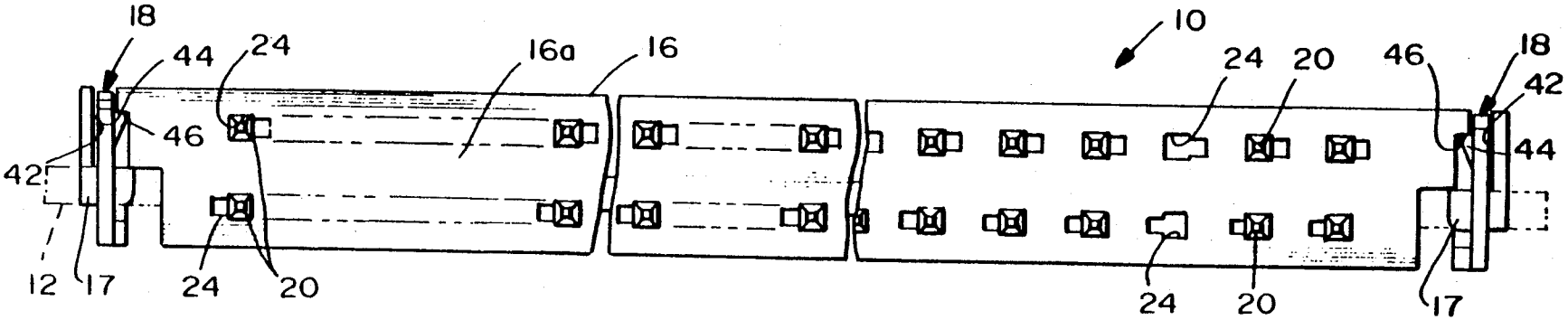
FIG. 3 is a side elevational view of the mating side of the electrical connector with the printed circuit board shown in phantom.

Referring to the drawings in greater detail, and first to FIGS. 1-3, the invention is embodied in an electrical connector or pin header, generally designated 10, for surface mounting on a printed circuit board 12 which has a plurality of circuit traces 14 on one side 12*a* of the board leading toward an edge 12*b* of the board. The connector includes an elongated dielectric housing 16 along with a pair of locking clips, generally designated 18, near opposite ends of the housing for mounting the housing to side 12*a* of circuit board 12 adjacent an edge 12*b* thereof. Housing 16 has an elongated center portion 19*a*, between a pair of end wing portions 19*b*. The center portion projects through a rectangular cut-out or notch 12*c* in printed circuit board 12. The housing is unitarily molded of plastic material or the like. A pair of positioning pegs 17 extend downwardly from housing 16 and fit into holes in the board.

A plurality of terminals are mounted in appropriate through passageways in housing 16, and each terminal includes a contact pin 20 at one end and a surface mount solder tail 22 at an opposite end. Contact pins 20 project through openings 24 (FIG. 3) in a mating face 16*a* of housing 16, away from edge 12*b* of circuit board 12 as seen in FIGS. 1 and 3, for mating with appropriate socket terminals of a complementary electrical connector (not shown). Surface mount tails 22 project from openings 26 (FIG. 1) in a rear face 16*b* of housing 16 for interconnection to circuit traces 14, as by soldering.

Figure 5:
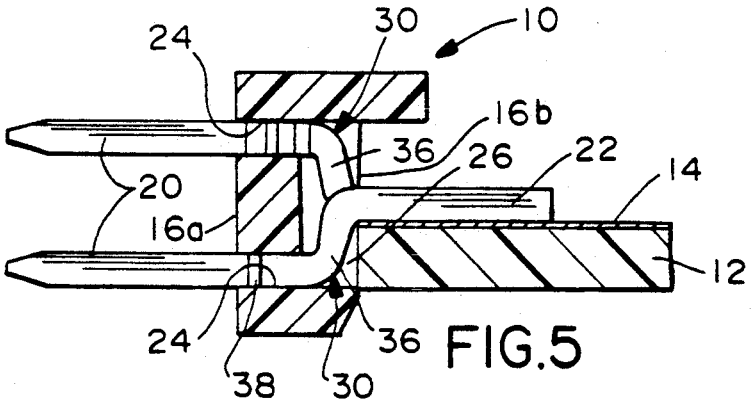
FIG. 5 is a vertical section taken generally along line 5—5 of FIG. 2.

As seen best in FIG. 5,, contact pins 20 are oriented generally parallel to circuit board 12 and in two rows longitudinally of housing 16. It can be seen in FIG. 3 that the contact pins are arranged in vertically aligned pairs with one pin in each pair being disposed in each of the two rows and with the pins in each pair being in a plane generally perpendicular to the circuit board. On the other hand, as best seen in FIG. 5, surface mount tails 22 of the terminals are arranged in a common plane for surface engagement with circuit traces 14 on side 12*a* of circuit board 12.

The invention contemplates that all of the terminals of connector 10 be of an identical construction, with the terminals in one row thereof being oriented 180° relative to the terminals in the other row thereof. A single terminal, generally designated 30, is shown in FIG. 4, and a pair of terminals are shown in FIG. 5.

Referring specifically to FIG. 4, it can be seen that contact pin 20 is at one end of terminal 30 and surface mount tail 22 is at the opposite end of the terminal, as described above. The contact pin defines an axis 32 therethrough. Surface mount tail 22 defines its own axis 34. The terminal is stamped and formed from sheet metal material, with the contact pin surface mount tail having generally rectangular cross-sections, and to include a first intermediate portion 36 between the contact pin and the surface mount tail. This intermediate portion offsets the surface mount tail from the contact pin in a horizontal direction (i.e., parallel to the circuit board) when the terminals are mounted in the connector housing and the connector is mounted to the circuit board. A second intermediate portion 37 between the contact pin 20 and the surface mount tail 22 serves to offset the tail from the pin in a vertical direction. A barb 38 projects outwardly of intermediate portion 36 for biting into the plastic material of housing 16 to retain the terminal in the housing.

In particular, still referring to FIG. 4, it can be seen that surface mount tail 22 (i.e. its axis 34) is offset horizontally from contact pin 20 (i.e. its axis 32) as indicated by arrows "A". This represents the parallel direction relative to the printed circuit board. In addition, the surface mount tail is offset from the contact pin in a vertical direction as indicated by arrows "B". This represents the perpendicular direction relative to the circuit board.

Consequently, and now referring to FIG. 5, it can be understood that a pair of identical terminals 30 can be mounted in housing 16 of connector 10 so that contact pins 20 are in spaced vertical alignment, while surface mount tails 22 are in spaced horizontal alignment. This is accomplished simply by orienting the terminals 180° relative to each other, i.e. the terminals in one row thereof are oriented 180° relative to the terminals in the other row thereof. By offsetting the surface mount tails from the contact pins as indicated by arrows "B" in FIG. 4, it can be seen in FIG. 5 that the contact pins of any pair thereof are spaced vertically while the surface mount tails are maintained in a common horizontal plane. By offsetting the surface mount tails from the contact pins as indicated by arrows "A" in FIG. 4, it can be seen in FIG. 2 that the contact pins are maintained in vertical alignment while the surface mount tails of any pair of terminals are horizontally spaced. Therefore, identical terminals can be employed in the entire electrical connector, thereby reducing tooling costs and inventory to, in turn, reduce the overall cost of the connector.

Figure 6:
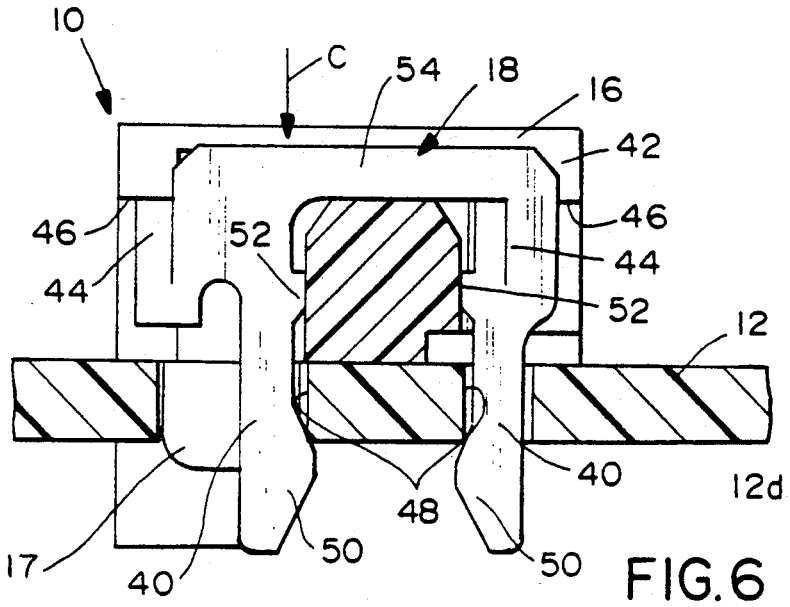
FIG. 6 is a vertical section, on an enlarged scale, taken generally along line 6—6 of FIG. 1.
Figure 7:
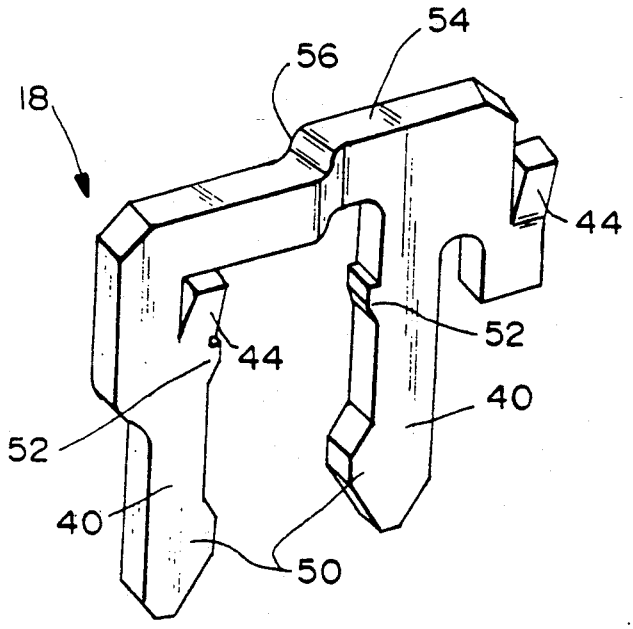
FIG. 7 is a perspective view of one of the locking clip of FIG. 6 but rotated 180°.

Referring to FIGS. 6 and 7 in conjunction with FIGS. 1-3, each locking clip 18 is fabricated as a stamped and formed metal component in a generally inverted U-shaped configuration to define a pair of legs 40. Each locking clip is located in a slot 42 formed in connector housing 16 near each opposite end thereof. Generally, each locking clip includes complementary interengaging retention means between the clip and the housing for retaining the clip on the housing. This retention means is provided by a pair of upwardly extending locking tabs 44 stamped and formed so that the end thereof extends outwardly of the body of the locking clip. When the clip is assembled to the housing into its respective slot 42 in the direction of arrow "C" (FIG. 6), locking tabs 44 snap under interior shoulders 46 that project into slot 42. The locked condition of the locking tabs behind shoulders 46 can be seen in FIGS. 3 and 6.

Each locking clip 16 also includes locking means independent of locking tabs 44 for locking connector 10 onto printed circuit board 12 to maintain connector 10 on the board during soldering operations of surface mount tails 22 to circuit traces 14. Specifically, resilient legs 40 project through openings 48 (FIG. 6) in circuit board 12. Each leg has a hook portion 50 which locks against an opposite side **12*d* of the circuit board. The hook portions of the pair of legs are in oppositely facing orientations, such as the inwardly mutually facing orientations shown in FIGS. 6 and 7. Barbs 52 are provided on the inside of legs 40 for creating an interference fit with the plastic material of the housing for additional stability of the clip. The bight portion 54 extending between legs 40 is bent as at 56** so that legs are in two different planes.

In assembly, locking clips 18 are assembled to connector housing 16 so that locking tabs 44 retain the clips on the housing. The connector then can be surface mounted onto printed circuit board 12 by inserting legs 40 of the clips through openings 48 in the circuit board until hook portions 50 snap under the opposite side **12*d* of the circuit board. By providing the locking tabs 44 for securing the locking clips to the housing independent of the resilient legs 40**, insertion of the clips into the board does not tend to release the retention means between the clips and the connector housing.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In an electrical connector for surface mounting on a printed circuit board along an edge thereof, said board having a rectangular cut-out to define a portion of said edge, said connector including an elongated dielectric housing having a plurality of terminal receiving cavities, means for mounting the housing to one side of the circuit board along said edge thereof, a terminal mounted in each said cavity, each terminal having a contact pin at one end and a surface mount tail at an opposite end, the contact pins of the terminals being oriented generally parallel to the circuit board and arranged in two rows parallel to a longitudinal axis of the housing, and the surface mount tails of the terminals being arranged in a common plane for surface engagement with appropriate circuit traces on said one side of the circuit board, wherein the improvement comprises:

said terminals being of identical construction, each said terminal having first and second intermediate portions between and generally perpendicular to said contact pin and said surface mount tail, the first intermediate portion extending in a direction generally parallel to said longitudinal axis of the housing and the second intermediate portion extending in a direction generally perpendicular to said longitudinal axis, and with the terminals in one row thereof being oriented 180° relative to the terminals in the other row thereof.

2. In an electrical connector as set forth in claim 1, wherein the contact pins are arranged in pairs with one pin in each pair being disposed in each of said two rows and with the pins in each pair being in a plane generally perpendicular to the circuit board.

3. In an electrical connector as set forth in claim 2, wherein both the contact pins and the surface mount tails of the terminals are generally rectangular in cross-section defining sides thereof generally perpendicular to the circuit board.

* * * * *